US005643062A

United States Patent [19]

Joseph et al.

[11] Patent Number: 5,643,062

[45] Date of Patent: Jul. 1, 1997

[54] MANICURE MACHINE

[75] Inventors: James R. Joseph, 6497 College Ave., SE., Kentwood, Mich. 49548; Mark W. Groves, Columbus, Ohio

[73] Assignee: James R. Joseph, Kentwood, Mich.

[21] Appl. No.: 447,363

[22] Filed: May 23, 1995

[51] Int. Cl.[6] ..... B24B 23/00; B24B 27/08

[52] U.S. Cl. ..... 451/355; 451/311; 451/461; 451/296; 451/303

[58] Field of Search ..... 451/296, 311, 451/303, 344, 355, 415, 461, 358, 360, 363

[56] References Cited

U.S. PATENT DOCUMENTS

| | | | |
|---|---|---|---|
| 1,482,837 | 2/1924 | Buck . | |
| 2,258,012 | 10/1941 | Jeannotte . | |
| 2,389,665 | 11/1945 | Harris . | |
| 2,423,737 | 7/1947 | Tavano . | |
| 2,560,102 | 7/1951 | Guinn | 451/311 |
| 2,819,565 | 1/1958 | Werth | 451/303 |
| 2,976,652 | 3/1961 | Bedortha et al. . | |
| 3,126,021 | 3/1964 | May . | |
| 3,619,949 | 11/1971 | Welsch et al. | 451/296 |
| 3,713,255 | 1/1973 | Welsch . | |
| 3,754,556 | 8/1973 | Watkins . | |
| 3,823,513 | 7/1974 | Welsch . | |
| 3,913,594 | 10/1975 | Tsukamoto . | |
| 4,016,890 | 4/1977 | Fiorenza, Sr. et al. . | |
| 4,103,694 | 8/1978 | Burian et al. . | |
| 4,117,854 | 10/1978 | Rosenbloom . | |
| 4,137,926 | 2/1979 | Pao . | |
| 4,213,471 | 7/1980 | Burian et al. . | |
| 4,316,349 | 2/1982 | Nelson | 451/296 |
| 4,368,597 | 1/1983 | Fleckenstein . | |
| 4,411,106 | 10/1983 | Fleckenstein et al. . | |
| 4,440,182 | 4/1984 | Holm . | |
| 4,478,232 | 10/1984 | Yasuda . | |
| 4,683,897 | 8/1987 | McBride . | |
| 4,753,253 | 6/1988 | Hutson . | |
| 4,858,390 | 8/1989 | Kenig . | |
| 4,924,578 | 5/1990 | Chagnon et al. | 451/461 |
| 5,033,552 | 7/1991 | Hu | 451/461 |
| 5,161,552 | 11/1992 | Kathuria . | |
| 5,168,658 | 12/1992 | Price | 451/311 |

*Primary Examiner*—Robert A. Rose
*Assistant Examiner*—George Nguyen
*Attorney, Agent, or Firm*—Price, Heneveld, Cooper, DeWitt & Litton

[57] ABSTRACT

A manicure device which is well suited for filing or buffing the convex top surfaces and the outer convex edges of fingernails and toenails includes a flexible, textured belt disposed in a cartridge which is detachably secured to a housing containing a high speed electric motor. The casing includes bearings over which the belt passes when the device is being used, and a belt opening which exposes a portion of the textured surface of the belt so that a fingernail can be pressed thereto. The machine allows the belt to be pressed against a convex surface or edge of a fingernail or toenail, so that the belt will conform to the convex shape thereof and provide uniformly smooth filing or buffing. The cartridges are relatively inexpensive and easily replaced, which facilitates and promotes replacement of the cartridge whenever the machine is being used to file or buff the fingernails or toenails of a different person, whereby better hygiene is achieved.

26 Claims, 4 Drawing Sheets

MANICURE MACHINE

The invention relates to hand held manicuring machines for filing and buffing natural and artificial fingernails and toenails, and more particularly to a manicuring machine having a flexible, endless belt with an exposed abrasive surface, which is capable of conforming to the convex surfaces of fingernails and toenails to provide uniform abrasion of these surfaces and, hence, facilitate smoother, more uniform filing and buffing of fingernails and toenails.

BACKGROUND OF THE INVENTION

Motor driven fingernail filing devices can be useful for filing natural fingernails, but are especially advantageously employed for filing artificial fingernails to remove excess material from the artificial fingernails and to provide a smooth transition between the natural and artificial fingernail. Artificial fingernails can be applied by cementing a preformed plastic (e.g., acrylic) fingernail over a natural fingernail. An alternative method of applying artificial fingernails is to temporarily attach to the end of a finger an open mould which generally overlies the natural fingernail, apply a liquid thermosetting resin over the natural fingernail on to the open mould, and allow it to cure or harden into a solid. In either case, it is generally necessary to do a substantial amount of filing to conform the artificial fingernail to a desired shape and appearance, and to obtain smooth edges and smooth exposed surfaces. It is extremely fatiguing and time consuming to manually file artificial fingernails to the desired shape and smoothness, especially when this process is repeated a plurality of times. Accordingly, professional manicurists find it extremely beneficial to employ motor driven devices for filing and buffing fingernails in order to eliminate physical fatigue, save time, and reduce the risk of injury such as to the carpus of the manicurist on account of repeated manual filing.

Commercially available motor driven manicure devices have been generally limited to rigid wheels or burrs mounted on a rotatable shaft operatively coupled to the output shaft of a motor. These devices offer some time saving benefits and reduce physical fatigue for the user, but are generally poorly adapted for filing convex fingernail surfaces and edges, because they do not conform to the shape of the surface or edge to be filed. More specifically, while these conventional devices are very useful for filing the concave surfaces on the underside of a fingernail, the use of such devices for filing the top surface of a fingernail involves contacting a convex abrasive surface with a convex fingernail surface, which means that only a relatively narrow strip of the fingernail is being filed at any particular moment. Thus, great care in positioning, applying pressure, and repositioning these known devices must be exercised to smoothly file convex fingernail surfaces, and avoid filing grooves and other irregularities into the fingernail.

Another disadvantage with manicure devices having a rigid file element secured to a rotatable shaft is that the file element (wheel, burr, etc.) is not always easily replaceable, and the cost of the file element is not sufficiently low such that it could generally be regarded as a disposable part. The cost and difficulty associated with replacing the file element of these known manicure devices tends to discourage frequent replacement. Accordingly, such devices are not conducive to the promotion of good hygiene, because manicurists generally use the same file element on a plurality of different clients to avoid the time and expense associated with replacement of the file element.

Another disadvantage is that (wheel, burr, etc.) get dull causing excess heat build up. Because of the relative expense to replace a burr, the manicurists will tend not to change burrs as often as they should.

A still further disadvantage with manicure devices employing a rigid file element mounted on a rotatable shaft is that the file element is typically unshielded and filings, often in the form of minute particles, are thrown into the air where they can present a health risk if inhaled.

A manicure machine which employs a flexible, textured belt as a file element is shown and described by Watkins in U.S. Pat. No. 3,754,556. Watkins discloses that the machine includes flexible nail filing means which naturally yield to the arcuate shape of a fingernail impressed thereon. It is possible to press the edges of a fingernail through one of the narrow slots and against the textured belt causing it to yield and conform with the convex shape of the edge of the fingernail. However, because the textured belt is disposed beneath narrow slots in an upper housing wall or roof, it is impossible, or at least extremely difficult, to press the top of a fingernail against the textured belt to cause it to conform with the convex surface thereof.

The machine disclosed by Watkins also fails to overcome many of the remaining disadvantages inherent with conventional devices having rigid rotating file elements. In particular, replacement of the belt requires removing screws which secure the cover to the base, separating the cover from the base, removing one of the rollers from the associated support strut, replacing the belt, and reassembling the machine. Replacement of the belt in the device described by Watkins is even more difficult than replacing the wheels or burrs on most of the devices having rigid rotating file elements. Therefore, the machine disclosed by Watkins also fails to promote good hygiene, because most manicurists would tend to avoid the time and effort required to replace the belt for each new client.

SUMMARY OF THE INVENTION

The invention provides a manicure machine for quickly and easily filing convex fingernail and toenail surfaces and edges. The invention also allows quick and easy replacement of a relatively inexpensive file element, thus facilitating replacement for each new customer, and thereby promoting good hygiene.

The manicure machine includes a lightweight, high-speed motor which is preferably enclosed in a housing adapted to be held in the palm of a hand, a belt having an outer abrasive surface and an inner surface which is positively engaged by a driving roller operatively coupled to an output shaft of the motor, and at least one bearing surface which, together with the driving roller, engage the inner surface of the belt and apply a low tension thereto. The belt is preferably disposed in an inexpensive belt cartridge which snaps onto or is otherwise quickly connectable to the manicure machine. The belt cartridge contains an abrasive belt which can have a grinding or buffing surface, and at least one idler roller or other bearing surface which cooperates with a drive roller to apply an appropriate low tension to the belt. The cartridge also includes a belt opening which exposes a portion of the abrasive surface of the belt. In order to facilitate filing of the convex top surface of a fingernail or toenail (either artificial or natural), at least one of the edges of the belt is preferably disposed outwardly of the interior of the casing at the belt opening. This allows the belt to flex and at least partially conform to the convex top surface of a fingernail or toenail to allow more uniform and smoother filing thereof.

An additional advantage of the invention is that minute filings, which are thrown in a direction generally tangential to the portion of the surface of the filing element which is in contact with the fingernail or toenail, have a tendency to follow the path of the belt and collect within the belt grinder assembly or cartridge, thereby reducing the amount of airborne filing particles generated by use of the invention as compared with the use of typical filing machines having rigid rotating file elements.

In accordance with a preferred aspect of the invention, a modular gear reduction assembly, for reducing the rotational speed and increasing the torque of the driving pulley relative to the output shaft of the motor, is detachably secured to the motor housing, with the belt grinder assembly being detachably secured to the gear reduction module. The belt grinder assembly and gear reduction module can be quickly disconnected as a unit from he motor housing, and replaced with a rotary file module. The rotary file module includes a housing to which a shaft is rotatably mounted. The shaft has a quick-connect coupling on one end which operatively engages the motor output shaft and has a rigid rotatable file element, such as a burr, on the other end. The modules allow flexibility, convenience, and economy by using a single motor in combination with easily detachable, alternative filing modules, one of which is ideally suited for filing the top convex surface and convex edges of a fingernail or toenail, and another which is best suited for filing the bottom concave surface of a fingernail or toenail.

In accordance with an important principle of the invention, the abrasive belt of the manicure machine is maintained under a very low tension as compared with conventional belt grinding tools, so that accurate conformation of the belt with the convex surface of a fingernail or toenail can be easily achieved by applying very low pressure between the fingernail or toenail being filed and the abrasive belt. The low belt tension allows a manicurist to quickly and easily achieve smooth filing of a fingernail or toenail with minimal muscle strain. The low belt tension allows the use of a relatively small, low power motor, and reduces the risk of discomfort or injury to the person whose fingernail or toenail is being filed. A consequential advantage of using low belt tension is that tracking of the belt over the belt path defined by a driving roller and one or more additional idler rollers or other bearing surfaces can be easily maintained by merely restraining the edges of the belt such as between substantially parallel surfaces which are substantially perpendicular to the abrasive surface of the belt and which are spaced apart by a distance generally only slightly in excess of the width of the belt. Preferably, the belt is restrained by opposing walls which each have a surface generally perpendicular to the abrasive surface of the belt and adjacent to one of the edges of the belt.

In accordance with a further aspect of the invention, a concave surface of an arcuate platen is preferably disposed adjacent the inner surface of the belt to limit the amount of the tension which can be applied to the belt. The convex surface of the platen helps prevent tearing or rupturing of the belt if excessive force is applied between a fingernail or toenail and the belt, and also helps ensure good conformity between the belt and a convex surface of a fingernail or toenail if excessive force is applied therebetween.

In accordance with another aspect of the invention, an easily replaceable belt cartridge adapted to be detachably secured to a manicure machine is provided. The belt cartridge includes a casing containing an abrasive belt and at least one bearing which the belt passes around when the cartridge is mounted to the manicure machine. The casing is at least partially open to expose at least a portion of the belt to provide sufficient access for filing a fingernail or toenail.

An important advantage of providing a filing machine which is adapted for use with a belt cartridge is that a variety of belt cartridges containing different grit abrasive surfaces can be provided to allow a manicurist to easily switch between different abrasive surfaces as needed to achieve coarse filing, fine filing, buffing, etc.

These and other features, objects, and benefits of the invention will be recognized by those who practice the invention and by those skilled in the art, from the specification, the claims, and the drawing figures.

DESCRIPTION OF THE PREFERRED EMBODIMENTS

Figure 1:
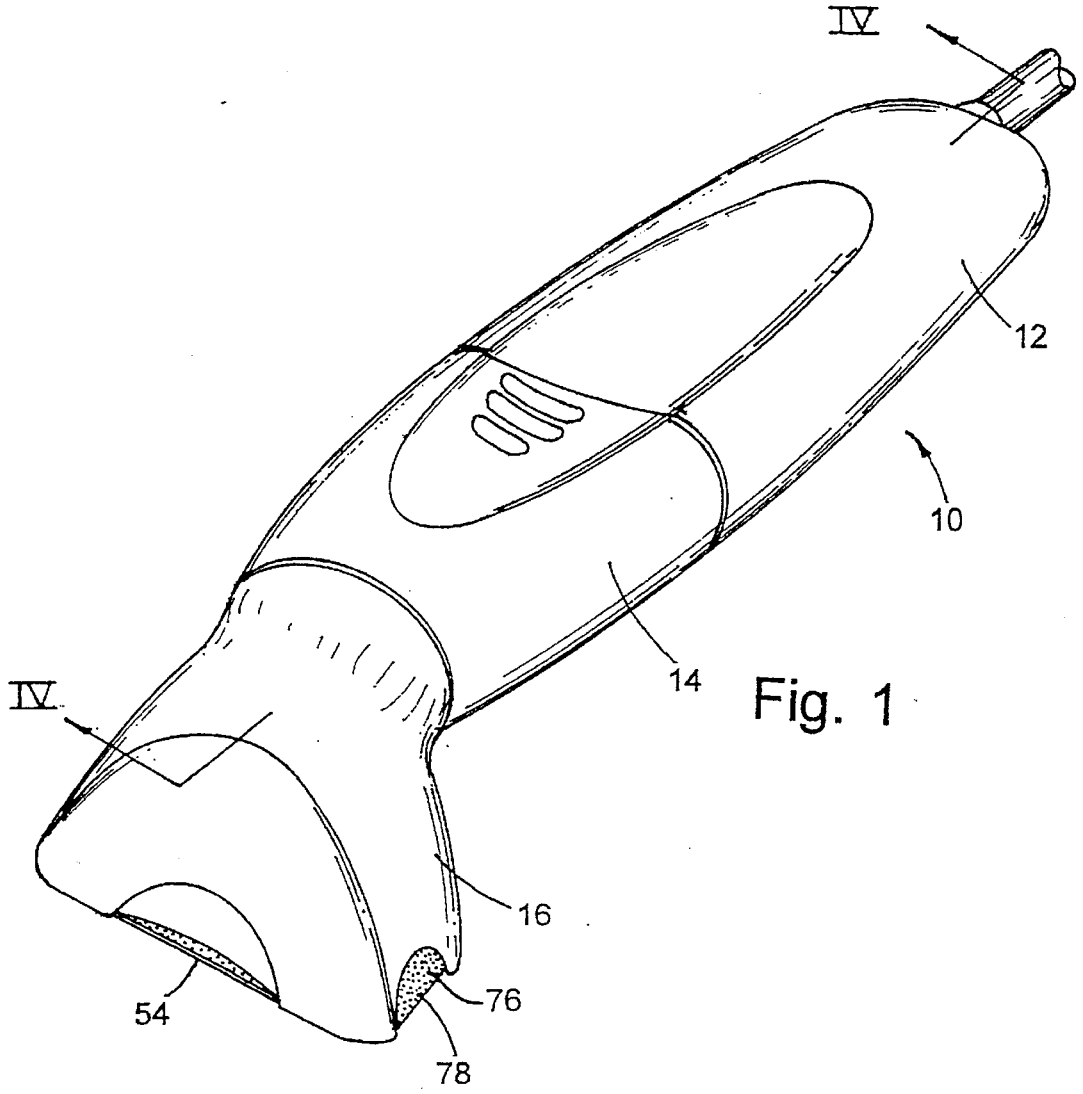
FIG. 1 is perspective view of a belt grinder manicure machine in accordance with the invention.
Figure 2:
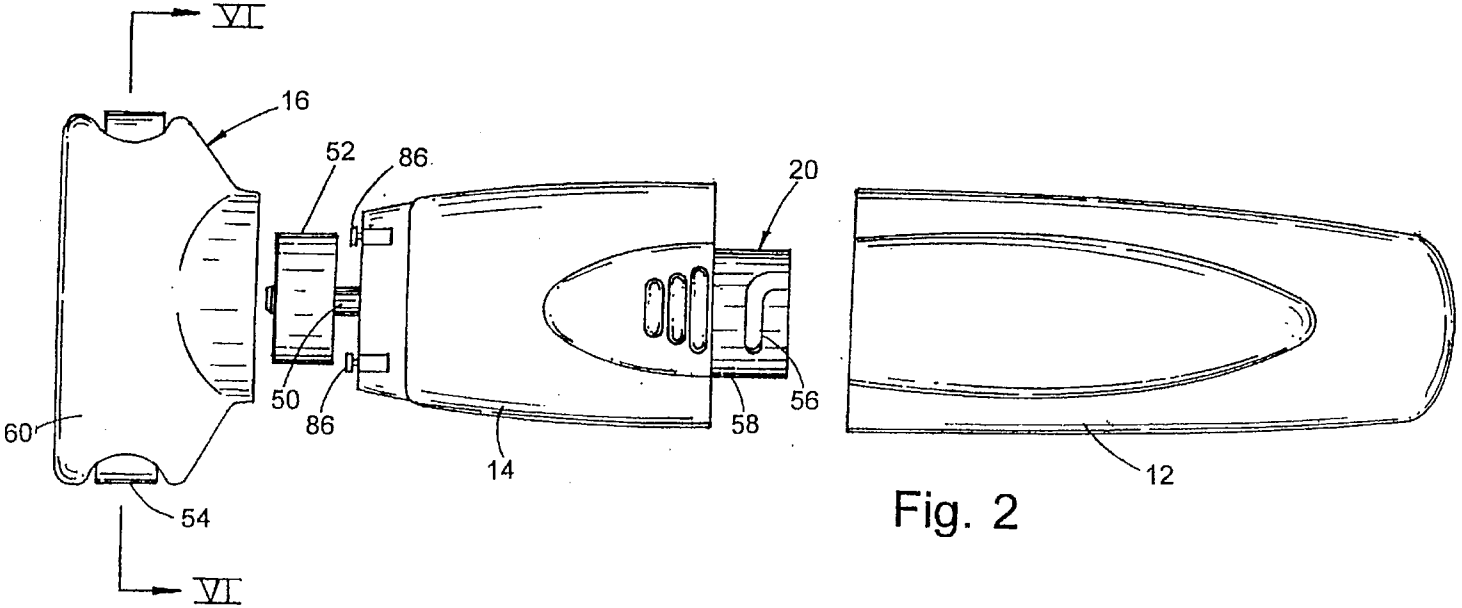
FIG. 2 is a top plan view of the machine shown in FIG. 1, showing a belt grinder assembly or cartridge separated from a gear reduction module which is separated from a motor housing.

With reference to FIGS. 1 and 2, there is shown a belt grinder manicure machine 10 which, in accordance with the principles of the invention, includes a plurality of modules or components having quick-connect couplings, including a motor module 12, a gear reduction module 14, and a belt cartridge 16. The term "quick-connect coupling" as used herein embraces generally any of many well known means for rapidly, detachably securing one component to another. Such means include any of various frictional interference fits between two components, at least one of which has resiliently biased portions which engage portions of the other when pushed together, and, optionally, twisted. For example, quick-connect couplings include various plug and socket arrangements, various resiliently biased tabs on one component which engage detents on another component, various bayonet-type couplings, etc. Also included among quick-connect couplings are components which are quickly screwed together, e.g., one component having an externally threaded projecting portion which is screwed into an internally threaded socket such as with a quarter turn.

The word "manicuring" as used herein refers to filing, buffing, polishing, or other surface treatment of a nail involving the removal of material from the nail by an abrasive medium. The word "nail" as used herein refers to fingernails and toenails, including both artificial and natural nails.

Figure 3:
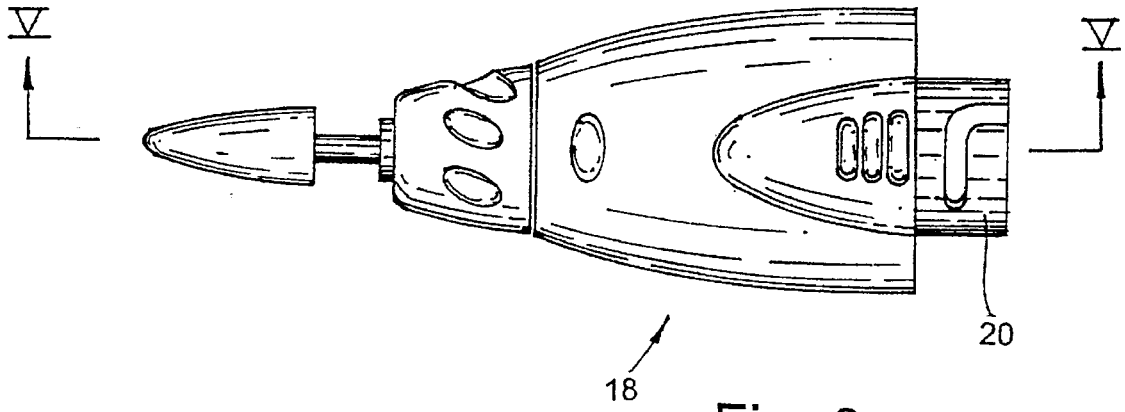
FIG. 3 is a top plan view of a rotary file module adapted to be quickly coupled with the motor housing shown in FIG. 2.

A rotary file module 18, shown in FIG. 3, can be detachably secured to the motor module 12 as desired, such as to file the concave surfaces on the underside of a fingernail. The rotary file module 18 and the gear reduction module 14 have the same type of coupling interface 20, so that the gear reduction module and the rotary file module are interchangeably mountable onto the motor module 12.

The motor module includes a housing 22 which is suitably shaped and sized to be gripped in the palm of a hand. A relatively inexpensive lightweight, high-speed motor 24 is securely contained within the housing 22. Suitable electric motors are commercially available from a variety of suppliers and manufacturers, and can be readily selected by those having ordinary skill in the relevant arts. The motor 24 is preferably powered by direct current delivered through an electrical cord 26 having two wire conductors electrically connected to the D.C. output of a standard A.C. powered transformer (not shown). The motor preferably operates at about 3,000 to about 35,000 rpm and delivers from about 3 to about 7 ounce-inches of stall torque.

The output shaft 28 of the electric motor 24 passes through a bulkhead 30, in the motor housing 22. The end of the output shaft 28 is disposed within a recessed space 32 of the housing and has fixedly secured thereto a plug-type coupling 29 with a transverse pin 34 which engages a V-notch 35 on one end of a socket-type tubular coupling 36 on input shaft 37 of the gear reduction module 14. The tubular coupling 36 slidingly receives shaft 37, and is biased outwardly toward coupling 29 on shaft 28 by a spring 39 which engages one of the bearings 41 which hold shaft 37 in parallelled relationship with the housing 48 of gear reduction module 14 and an edge of the coupling 36 to provide easy, reliable coupling of the motor output shaft 28 with the input shaft 36 of the gear reduction module when it is attached to the motor housing 22. Rotational movement of shaft 28 and coupling 29 is transferred directly to coupling 36 by pin 34 which engages the edges of V-notch 35. The rotational movement of coupling 36 is transferred from the edges of a longitudinal slot 45 thereof to a pin 43 which is fixed to and radially projects from shaft 37. Slot 45 also limits longitudinal movement of coupling 36 relative to shaft 37. Fixedly secured to the other end of shaft 37 is a pinion gear 38 having teeth which mesh with the teeth of a plurality of planetary gears 40 circumferentially disposed around the pinion gear 38 and rotatably mounted to a plurality of axles 42 which are also rotatably secured to a disc 44. The teeth of the planetary gears 40 also mesh with the internal teeth of a ring gear 46 which is fixedly secured to the housing 48 of the gear reduction module. Ring gear 46 acts as a constraint against radially outward movement of the planetary gears 40 and keeps the axles 42 parallel with the input shaft 37. A drive shaft 50 is fixedly secured to the disc 44 with its axis substantially in alignment with the axis of the input shaft 37. Drive shaft 50 protrudes outwardly through an opening in the housing 48 of the gear reduction module and through an axial bore passing through the end of the gear reduction module opposite of the end attached to the motor housing. The shaft 50 has attached to its outwardly protruding end a drive roller 52. The drive roller 52 preferably has a gripping outer cylindrical drive surface (such as an elastomeric polyurethane surface) which engages and drives an endless belt 54.

The drive roller 52 can be fixed to shaft 50, which is journalled within housing 48 of gear reduction module 14 by bearings 55, by splines, a pin, a press fit, or the like. Preferably, roller 52 is fixed to shaft 50 and passes through an opening in the back of the belt cartridge.

The gear reduction module can be secured to the motor module by any of various known quick-connect coupling devices. The illustrated quick-connect coupling means (FIG. 2) includes a pair of L-shaped slots 56 on opposing sides of a cylindrical skirt 58, and a pair of knobs (not shown) at the ends of rods (also not shown) which project radially inwardly from the inner walls of the recessed space 32 of the motor housing 22. The gear reduction module 14 is detachably secured to the motor module 12 by aligning the openings of slots 56 on skirt 58 with the knobs on the motor housing, pushing the modules together, and rotating the modules in the appropriate direction about a quarter of a revolution relative to one another. The modules can be quickly separated thereafter by simply reversing the process by rotating the modules about a quarter of a revolution in the opposite direction and pulling them apart. Various alternative quick-connect couplings can be used instead without departing from the spirit and scope of the invention, as the particular quick-connect coupling used is not an essential feature of the invention.

While it is presently believed that a gear reduction module is useful for achieving the optimum balance of economy and performance, it will be readily apparent to those skilled in the art that various alternative gear reduction mechanisms can be used to achieve the desired reduction in rotational speed and increase in torque between the output shaft 28 of the motor and the drive shaft 50. Likewise, those skilled in the art will appreciate that by appropriately designing or selecting a motor 24 which delivers the desired rotational speed and torque it is possible to eliminate the gear reduction module and mount the drive roller 52 directly to the output shaft 28 of the motor 24 and attach the belt cartridge 16 directly to the motor module. Those skilled in the art will also appreciate that the motor need not be disposed within a housing to which the belt grinder is attached, but can instead be positioned remote from the belt grinder with the driving pulley for the belt and the motor output being operatively coupled through a flexible shaft. A handpiece driven by a series of pulleys and drive belts connected to a motor can also be used with the invention. Variable speed and torque motors, such as remote A.C. motors coupled to the drive shaft or a hand held filing tool through a flexible shaft, can be used to allow interchangeable use of a rotary burr-type module and a belt grinder module without any need for a gear reduction assembly. Although electric motors are preferred, it should be understood that pneumatic or other motors can also be successfully employed with the invention.

In order to achieve a belt speed of from about 125 to about 600 surface feet per minute (sfpm) in an inexpensive compact, hand-held filing machine having a detachable belt cartridge and gear reduction module which are interchangeable with a rotary file module having a rigid burr which is desirably rotated at from about 3,000 to about 35,000 rpm, the motor 24 is preferably selected or designed to operate at from about 3,000 to about 35,000 rpm and deliver from about 3 to about 7 ounces-inches of stall torque, and the gear reduction mechanism of module 14 is preferably designed to provide at the output or drive shaft 50 a rotational speed of from about 750 to about 3,600 rpm and to deliver from about 12 to about 28 ounces-inches of stall torque.

Figure 6:
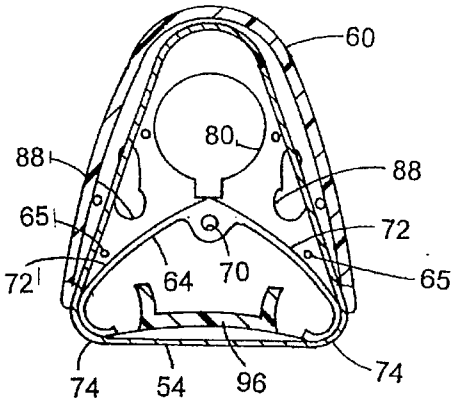
FIG. 6 is a transverse cross section of the belt grinder assembly or cartridge, as viewed along lines VI—VI of FIG. 2.
Figure 5:
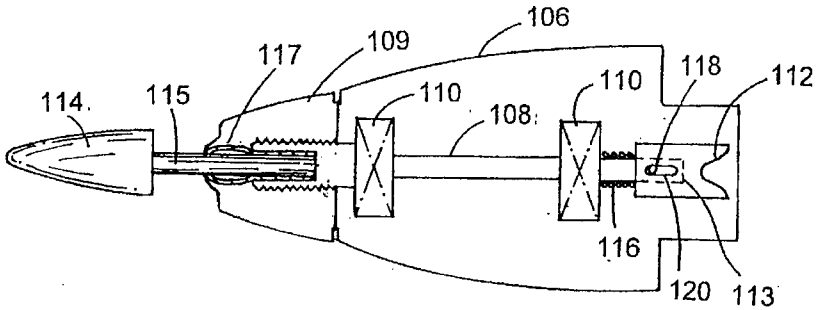
FIG. 5 is a longitudinal cross section of the rotary file module shown in FIG. 3, as viewed along liens V—V of FIG. 3.
Figure 7:
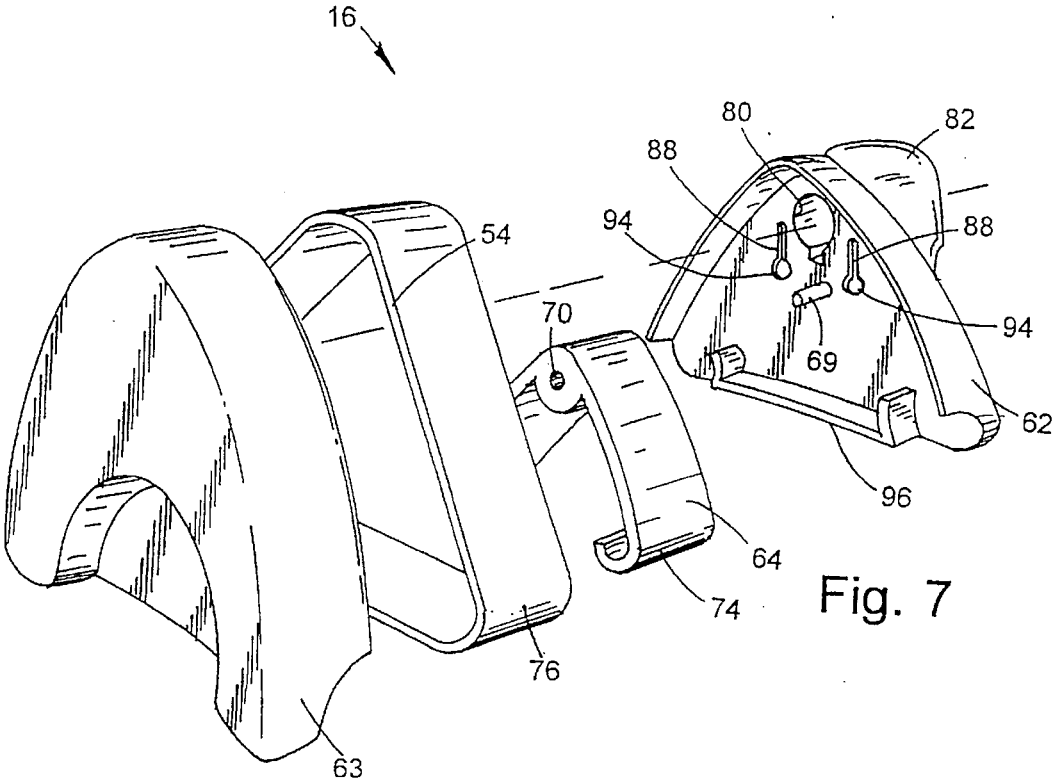
FIG. 7 is an exploded perspective view showing how the various components of the belt grinder cartridge of FIG. 6 are arranged and assembled.

The belt cartridge (as best illustrated in FIGS. 6 and 7) includes a casing 60 which is preferably comprised of two molded thermoplastic parts 62 and 63 which are suitably secured to one another such as along their edges or at pin molded in the interior walls of parts 62, 63 using adhesives or ultrasonic welding methods. The parts 62, 63 can be fastened together with a snap-type tongue and groove arrangement, with adhesives, by thermal fusion techniques such as ultrasonic welding, with conventional fasteners such as screws, or combination thereof. A belt tensioner 64 is disposed within the interior of the casing 60. The tensioner 64 is restrained by retainer pins 65 or the edge walls 66 of the casing 60 and by pivots pin 68, which projects inwardly from the interior wall of the casing part 62, and through a bore 70 at the apex of the tensioner. The tensioner includes two outwardly, downwardly extending arms 72 which curve at their respective ends to provide bearings 74 having arcuate surfaces over which the belt 54 slides. Rollers can be used instead of slide-type bearings. The arms 72 of the tensioner are flexible and resilient so that when the cartridge 16 is attached to the gear reduction module with the roller 52 engaging the inner surface of the belt 54, tension is placed on the belt and on the slide surfaces which cause the arms 72 to flex inwardly toward each other so that the arms are spring biased outwardly during normal use of the device when the belt cartridge, gear reducer, and motor module are suitably attached together. The abrasive belt 54 is disposed within the casing 60 and travels a generally triangular path around the drive roller 52 and each of the two bearings 74. The belt 54 has an outward textured or abrasive surface 76 which can be of any desired grit. Alternatively, belt 54 can have an outward buffing surface for use in polishing fingernails and toenails.

The casing 60 includes a bottom opening 78 which exposes the outward surface of that portion of the belt which is at and between the bearings 74. The relationship between the dimensions of, and between, the drive roller 52 and tensioner 64, and the circumferential length of the belt 54 is such that the belt is always under a relatively low tension of from about 3 ounces to about 4 pounds, preferably about 5 ounces to about 1 pound, which depends in part upon the displacement of the belt by a fingernail or toenail impressed upon the outward surface 76 of the belt 54 through the opening 78. To allow sufficient exposure of the outward surface 76 of the belt 54 through the opening 78 so that the belt can conform to and smoothly file the convex surfaces and edges of a fingernail or toenail, the distance between rollers or bearings should be at least about ¼ inch or ½ inch long. To maintain the desired low belt tension in an inexpensive compact, hand-held belt filer, it is generally desirable to limit the length between the rollers or bearings to about 2½ or 3 inches. With longer distances between rollers or bearings, it becomes difficult and impracticable to maintain the desired belt tension during use. The opening 78 is preferably at least as wide as the belt 54. The exposed belt surface 76 preferably extends outwardly beyond the outer edges of the casing 60 which define the opening 78, whereby the casing does not interfere with the ability to press the exposed belt against the top of a fingernail or toenail and conform to the convex surface thereof to achieve uniformly smooth filing. The width of the belt is generally from about ⅛ to about 3 inches. The back part 62 of the casing 60 has an opening 80 through which the drive roller 52 extends through and into the interior of casing 60 to engage the inner surface of belt 54. The part 62 also includes rearwardly projecting portion 82 which forms a continuous sheath between the gear reduction module 14 and the cartridge 16. The gear reduction module 14 can include a sliding locking pin 57 which is urged by a spring 59 through a rectangular slot at the bottom of opening 80 to prevent the entire cartridge 16 from rotating relative to the gear reduction module 14 during use and to help ensure proper alignment. The forward face of the gear reduction module 14 can include a pair of alignment pins 86 (FIG. 2) which pass through keyhole-shaped slots 88 in the back wall of the casing 60 to aid in achieving proper orientation between the gear reduction module 14 and the cartridge 16.

Figure 4:
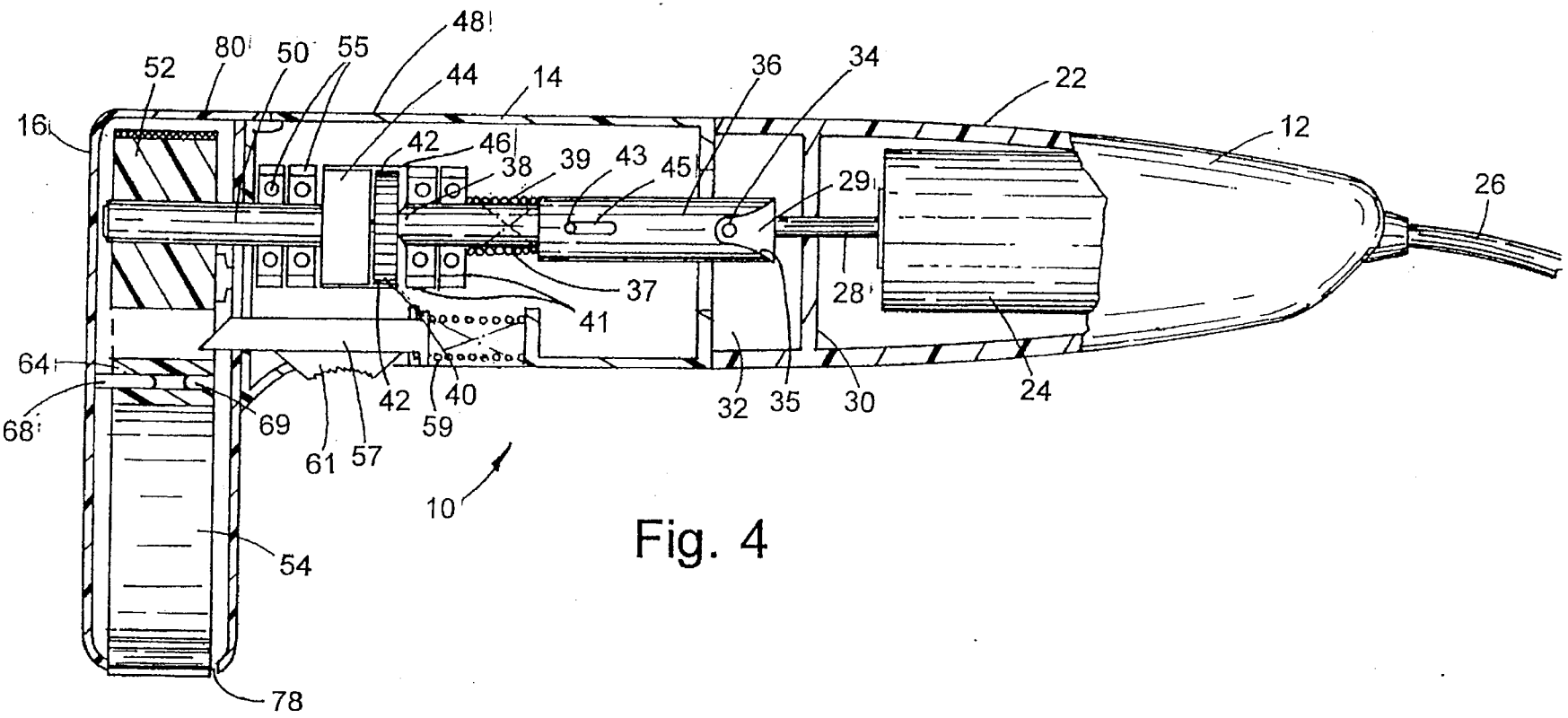
FIG. 4 is a longitudinal cross section of another embodiment of the present invention, with is generally similar to that shown in FIG. 1.

The cartridge 16 is removably secured to the gear reduction module 14 by gripping the cartridge 16 in one hand and the module 14 in the other hand, aligning the pins 86 with the circular openings 94 at the bottom ends of slots 88, pushing the module 14 and cartridge 16 together so that the heads of pins 86 pass through the openings 94 into the interior of casing 60, sliding the cartridge downwardly relative to the module 14 so that the shanks of pins 86 slide upwardly along to the top of slots 88, and sliding the locking pin 57 toward the cartridge so that it engages a notch 92 in opening 80 to prevent the cartridge 16 from sliding upwardly and relieving the desired belt tension. The locking pin 57 is spring mounted to automatically thrust itself into the slot at the bottom of opening 80 when the cartridge is pushed downward. Sliding the locking pin 57 backwardly by applying appropriate force against button 61 (FIG. 4) releases the cartridge.

The casing 60 desirably includes an arcuate platen 96 inwardly disposed relative to the belt 54 and belt opening 78. The platen serves as a means of limiting the extent to which the belt 54 can be tensioned by pressing a fingernail or toenail against the belt surface 76. The platen 96 also limits the amount of pressure which can be exerted between the belt 54 and the drive roller 52, so that if the belt is immobilized by exerting excessive pressure on the belt against the platen, the drive roller will spin freely acting as a slip clutch. This can be an important safety feature which prevents excessive friction between a nail and the abrasive belt that could otherwise result in excessive heat generating or burning causing discomfort or injury to the person whose nails are being treated.

Figure 8:
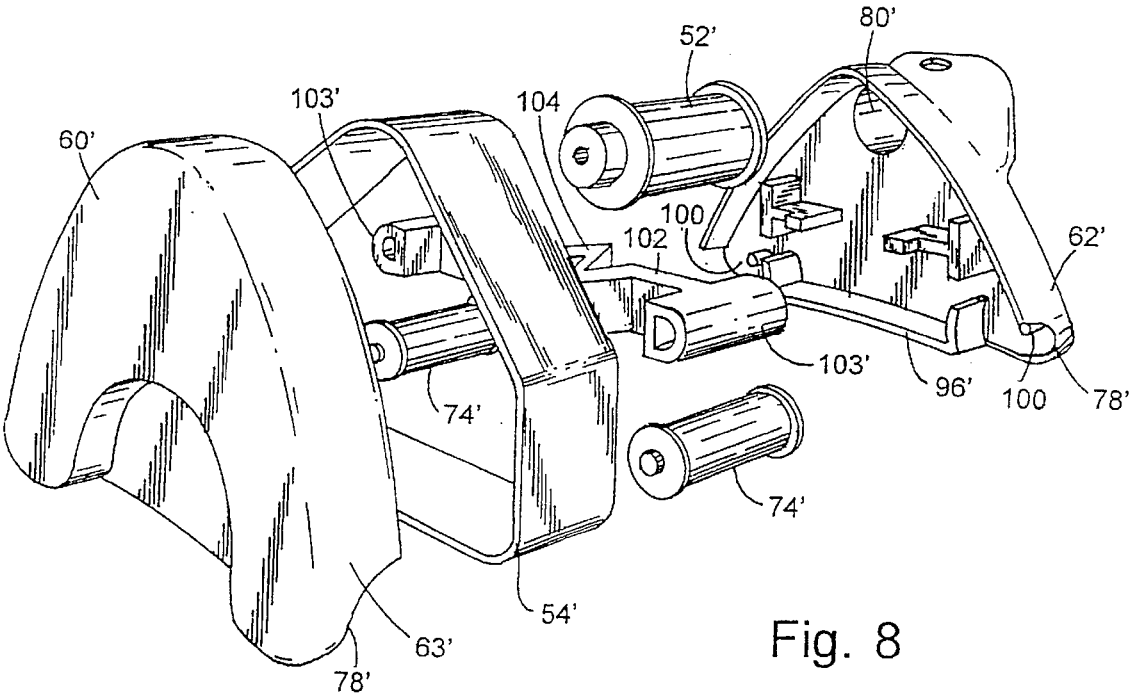
FIG. 8 is an exploded perspective view of yet another embodiment of the present invention, showing how various components of an associated belt grinder cartridge, which has a driving pulley rotatably mounted therein, are arranged and assembled.

While the drive roller 52 is preferably fixedly secured to the shaft 50 in order to reduce the cost of the cartridge 16 so that it can more easily be regarded as a consumable or disposable unit, it is also possible to advantageously incorporate the drive roller into the cartridge. Accordingly, FIG. 8 shows an alternative embodiment of the invention wherein the cartridge 16' includes a drive roller 52' disposed within and rotatably secured to the casing 60'. The casing is preferably formed from two injection molded thermoplastic parts 62' and 63' which are suitably secured together such as with adhesives by thermal fusion techniques such as an ultrasonic welding, with conventional fasteners such as screws, or combinations thereof. The cartridge 16' contains a pair of idler spools 74' having bearing surfaces around which the belt 54' travels. The spools 74' can be mounted within embossed bearings 100 integrally formed with the casing parts 62', 63'. A tensioner 102 having an integrally formed spring portion 104 and arcuate bearing surface 103' which engage the inner surface of belt 54' is provided to apply a suitable amount of tension to belt 54' regardless of the amount of pressure applied thereto by a fingernail or toenail pressed against the outer surface 76' of the belt. The casing part 62' includes an opening 80' through which a shaft can be inserted into an axial socket (not shown) of the drive roller 52'. The drive shaft can be keyed or splined to engage the roller 52', for example, by forming the end of the drive shaft so that it has a D-shape cross section which mates with a D-shape socket in the drive roller 52'. A platen 96' can be provided to limit the extent to which the belt 54' can be tensioned by pressing a fingernail or toenail against the belt surface 76'. An opening 78' is provided to expose a portion of the belt surface 76'. The dimensions and characteristics of the belt opening 78' and other features of the cartridge 16' are generally similar to those of the preferred cartridge 16, shown in FIGS. 6 and 7, and described above.

The interior walls of casing 60 and 60' constrain the belts 54 and 54', respectively, to constrain lateral movement and keep the belts on track, thereby allowing minimum belt tension while eliminating the need for flanged rollers or means for adjusting the axial orientation of rollers 52, 52' and/or spools 74'.

While it is presently believed that a detachably securable belt cartridge provides the most convenient means for allowing quick and easy replacement of the belt, it is also possible to permanently affix the drive roller and arcuate surface or surfaces (belt slide or idler rollers) mounted on spring biased arms directly to a common base to place the drive roller and spring biased arms in fixed relationship to one another, and to detachably secure a cover plate to the common base with the drive roller, arcuate surface or surfaces, and belt disposed therebetween, with the cover plate and base serving to constrain the belt (which is under relatively low tension) and keep it on track around the drive roller and arcuate surface or surfaces. Thus, an important feature of the invention is to constrain the belt between opposing surfaces to maintain proper tracking of the belt which is maintained under a relatively low tension of less than about 4 pounds of force and more preferably from about 3 ounces to about 1 pound. Such constraint is not needed with conventional belt sanders wherein the belt is typically under relatively high tension, which in combination with crowned rollers and adjusters keeps the belt on track.

A rotary file module 18 having quick-connect features substantially identical to those of the gear reduction module 14 and engagable with the mating quick-connect features of the motor module 12 can be detachably secured to the motor module to provide a rotary tool which is ideally suited for filing the underside of a fingernail or toenail. The rotary file module includes a housing 106 to which a shaft 108 is rotatably mounted in bearings 110. At the end of the shaft 108 that is adjacent to the quick-connect couplings, there is provided a V-notch 112 on a coupling 113 which slides over shaft 108. The V-notch engages for pin 34 on coupling 29 secured to the motor output shaft 28. The opposite end of the shaft 108 is externally threaded for receipt into a female threaded chuck 109. A rotary burr 114, useful for filing concave surfaces and edges, is fixedly attached to a shaft 115 which is inserted into an axial bore in shaft 108 through an axial opening in chuck 109. The shaft 115 is retained in the axial bore of shaft 108 by a collet 117 which engages shaft 115 and chuck 109 holding them in fixed relationship to one another when chuck 109 is tightened (screwed) onto the threaded end of shaft 108. The shaft 108 is biased toward the motor output shaft by spring 116 having ends engaging one of the bearings 110 and an end of coupling 113. Rotational movement of coupling 113 is transmitted to pin 118 fixed to and radially projecting from shaft 108. Sliding movement of the coupling 113 is limited by slot 120 through which pin 118 projects.

While the invention has been described with emphasis on its utility with respect to filing fingernails and toenails, the invention can also be used in a variety of other applications. For example, hobbyists can use the invention for sculpting or sanding miniature models, podiatrists and others could use the invention for removing calluses, and orthodontists could find the invention useful for customizing or fabricating orthodontic appliances such as retainer brackets. More generally, the invention is not limited to any particular application, but instead could be useful for sanding, smoothing, or buffing a variety of surfaces.

It will be understood by those who practice the invention and by those skilled in the art, that various modifications and improvements may be made to the invention without departing from the spirit of the disclosed concept. The scope of protection afforded is to be determined by the claims and by the breadth of interpretation allowed by law.

The embodiments of the invention in which an exclusive property or privilege is claimed are defined as follows:

1. A manicure machine, comprising:

a housing adapted to be held in the palm of a hand and manually manipulated;

a motor mounted in said housing, and having an output shaft;

a drive roller operatively connected to and driven by the output shaft of said motor;

a flexible belt disposed within a cartridge which is detachably secured to said manicure machine, said cartridge defining an opening to expose an abrasive surface of said belt, said flexible belt passing around said drive roller and around bearing surfaces on said cartridge when said drive roller is rotated; said flexible belt having an abrasive outer surface for manicuring nails; and an arcuate platen disposed inwardly of said belt adjacent said opening, said arcuate platen having a concave surface opposing an inner side of said belt.

2. The machine of claim 1, wherein said bearing is supported on a resiliently biased arm which maintains tension on said belt, and said cartridge includes a casing having a belt opening for exposing a portion of said belt.

3. The machine of claim 2, further comprising a platen disposed inwardly of said belt adjacent to said belt opening to limit the tension which can be applied to said belt by an object impressed thereon.

4. The machine of claim 3, wherein said resiliently biased arms maintain a tension of from about 3 ounces to about 4 pounds of force on said belt during use of said machine regardless of the extent to which said belt is pressed toward said platen.

5. The machine of claim 1, wherein said cartridge includes at least two bearings, each supported on a resiliently biased arm which maintains tension on said belt, said belt passing around a path defined by said bearings and said drive roller.

6. The machine of claim 1, wherein the distance between said bearings is about ¼ to about 3 inches.

7. The machine of claim 1, further comprising a tensioner having resilient spring biased belt disposed within said cartridge to maintain tension on said arms.

8. The machine of claim 7, wherein said resiliently biased arms maintain a tension of from about 3 ounces to about 4 pounds of force on said belt during use of said machine regardless of the extent to which said belt is pressed toward said platen.

9. The machine of claim 1, further comprising a gear reduction module which is detachably secured to said filing tool, said gear reduction module including an input shaft and an output drive shaft which are operatively coupled by a gear mechanism which provides an output drive shaft rotational speed which is less than that of the input shaft and torque on the output drive shaft which is higher than that of the input shaft, said motor output shaft being coupled with said input shaft of said gear reduction module, said belt cartridge being detachably secured to said gear reduction module, and said drive roller being coupled with said output drive shaft.

10. The machine of claim 9, wherein said motor rotates said motor output shaft at from about 3,000 to about 35,000 rpm, and delivers from about 3 to about 7 ounce-inches of stall torque to said motor output shaft; and wherein said output drive shaft of said gear reduction module rotates at from about 750 to about 3,600 rpm, and delivers from about 12 to about 28 ounce-inches of stall torque to said output drive shaft.

11. The machine of claim 1, wherein said belt moves at a speed of from about 125 to about 600 surface feet per minute during operation of said machine.

12. The machine of claim 2, wherein said drive roller is rotatably mounted within said casing.

13. The machine of claim 1, where said drive roller is fixedly secured to a shaft which is operatively coupled to said motor output shaft.

14. The machine of claim 2, wherein the exposed belt surface extends outwardly from the cartridge beyond the outer edges of the casing which define said belt opening.

15. A belt cartridge adapted to be detachably secured to a manicure machine, comprising:

a casing in which an abrasive belt is disposed, and a bearing in said casing which said belt passes around when said cartridge is secured to said manicure machine, said casing defining an opening to expose an abrasive surface of said belt, and an arcuate platen disposed inwardly of said belt adjacent said opening, said arcuate platen having a concave surface opposing an inner side of said belt.

16. The belt cartridge of claim 15, wherein said bearing is supported or a resiliently biased arm which maintains tension on said belt when said cartridge is secured to a manicure machine.

17. The belt cartridge of claim 15, wherein the exposed belt surface extends outwardly from the cartridge beyond the outer edges of the casing which define said belt opening.

18. The belt cartridge of claim 15, wherein said casing includes two bearings each supported on a resiliently biased arm which maintains tension on said belt, said belt passing around a generally triangular path defined by said two bearings and a drive roller.

19. The belt cartridge of claim 15, wherein said belt opening exposes from about ¼ to about 3 inches of the length of the belt.

20. A manicure machine system having interchangeable attachments adapted for filing above and below fingernails and toenails, comprising:

a motor module having a motor with a motor output shaft, said motor disposed within a motor housing adapted to be held in the palm of a hand;

a gear reduction module which is detachably securable to said motor housing, said gear reduction module including an input shaft and an output drive shaft which are operatively couplable by a gear mechanism which provides an output drive shaft rotational speed which is less than that of the input shaft and torque on the output drive shaft which is higher than that of the input shaft, said motor output shaft being couplable with said input shaft of said gear reduction module;

a belt cartridge adapted to be detachably secured to said gear reduction module, said cartridge including a casing defining an interior containing an abrasive belt and a bearing, said belt being permanently encased within said cartridge, said belt being adapted to engage said drive roller and pass around said bearing and said drive roller when said cartridge is secured to said gear reduction module, said casing having a belt opening which exposes a portion of said belt and an opening through which said drive roller extends into the interior of said casing to engage said belt; and a rotary file module which is detachably securable to said motor module, said rotary file module including a housing to which a shaft is rotatably mounted, said shaft being couplable at one end of said motor output shaft and having a burr fixedly secured at the other end thereof.

21. A manicure machine, comprising:

a housing;

a motor mounted in said housing and having an output shaft;

a drive roller connected to and driven by the output shaft of said motor; and a belt cartridge adapted to be detachably secured to said housing, said cartridge including a casing containing a flexible belt having an abrasive outer surface for manicuring nails, said belt being permanently encased within said cartridge, said casing abutting said housing, whereby said drive roller and said output shaft are covered and inaccessible when said cartridge is secured to said housing.

22. A disposable belt cartridge adapted to be detachably secured to a manicure machine, comprising:

a casing containing an abrasive belt, said belt being permanently encased within said casing, said casing being comprised of at least two plastic parts which are secured to one another, said casing including a bearing which said belt passes around when said cartridge is secured to a manicure machine, said casing being at least partially open along it periphery to expose an abrasive surface of said belt.

23. The disposable belt cartridge of claim 22, wherein said plastic parts are secured together with adhesives, thermal fusion, or with a snap-type tongue and groove arrangement.

24. A manicure machine, comprising:

a housing;

a motor mounted in said housing and having an output shaft;

a drive roller connected to and driven by the output shaft;

a flexible belt having an outer abrasive surface, said belt disposed within a cartridge which is detachably secured to said manicure machine, said flexible belt passing around said drive roller and around bearing surfaces in said cartridge when said drive roller is rotated; said cartridge defining an opening to expose an abrasive surface of said belt and including a tensioner to maintain a tension of from about 3 ounces to about 4 pounds of force on said belt during use of said machine; and an arcuate platen disposed inwardly of said belt adjacent to said belt opening, said arcuate platen having a concave surface opposing an inner side of said belt.

25. A manicure machine, comprising:

a housing;

a motor mounted in said housing and having an output shaft;

a drive roller connected to and driven by the output shaft; and a belt cartridge including a casing containing a flexible belt disposed therein, said flexible belt being permanently encased within said casing, said flexible belt passing around said drive roller and around bearing surfaces in said cartridge when said drive roller is rotated, said flexible belt having an abrasive outer surface for manicuring nails, said casing having an opening through which the drive roller on said output shaft of said motor extends into said casing to engage said belt.

26. A disposable belt cartridge adapted to be detachably secured to a manicure machine, comprising:

a casing containing an abrasive belt, said cartridge including an arcuate platen having a concave surface opposing an inner side of said belt to limit tension which can be applied to said belt by an object pressed against said belt.

* * * * *